US006412418B1

(12) United States Patent
Shelton

(10) Patent No.: US 6,412,418 B1
(45) Date of Patent: Jul. 2, 2002

(54) AERIAL FIREWORKS PRODUCT

(76) Inventor: Gregory P. Shelton, 24073 24th St., Eagleville, MO (US) 64442

( * ) Notice: Subject to any disclaimer, the term of this patent is extended or adjusted under 35 U.S.C. 154(b) by 0 days.

(21) Appl. No.: 09/482,579

(22) Filed: Jan. 13, 2000

(51) Int. Cl.[7] ..... F42B 4/06
(52) U.S. Cl. ..... 102/349; 102/361
(58) Field of Search ..... 102/349, 361, 102/335; 244/3.3

(56) References Cited

U.S. PATENT DOCUMENTS

| | | | | | |
|---|---|---|---|---|---|
| 72,030 | A | | 12/1867 | Hadfield | |
| 133,234 | A | | 11/1872 | Licht | |
| 148,553 | A | | 3/1874 | Detwiller | |
| 276,007 | A | | 4/1883 | Detwiller | |
| 303,839 | A | | 8/1884 | Hadfield | |
| 310,598 | A | | 1/1885 | Linton | |
| 753,151 | A | | 2/1904 | Lloyd | |
| 1,610,645 | A | * | 12/1926 | Adler | |
| 2,700,337 | A | * | 1/1955 | Cumming | 102/49 |
| 3,060,854 | A | * | 10/1962 | Maretti | 102/34.5 |
| 3,944,168 | A | * | 3/1976 | Bizien et al. | 244/3.28 |
| 4,771,695 | A | | 9/1988 | Simpson | 102/343 |
| 4,917,015 | A | | 4/1990 | Lowery | 102/342 |
| H854 | H | * | 12/1990 | Madderra | 244/3.28 |
| 5,025,729 | A | * | 6/1991 | Cameron | 102/336 |
| 5,056,406 | A | * | 10/1991 | Pinson | 89/1.816 |
| 5,339,741 | A | * | 8/1994 | Craven et al. | 102/361 |
| 5,429,053 | A | * | 7/1995 | Walker | 102/342 |
| 5,567,907 | A | | 10/1996 | Westfall | 102/344 |
| 5,979,329 | A | * | 11/1999 | Collar | 102/361 |
| 5,988,071 | A | * | 11/1999 | Taylor | 102/473 |
| 6,240,849 | B1 | * | 6/2001 | Holler | 102/439 |
| 6,286,429 | B1 | * | 7/2001 | Marietta et al. | 102/342 |
| 6,283,033 | B1 | * | 9/2001 | Wu et al. | 102/352 |

* cited by examiner

*Primary Examiner*—Michael J. Carone
*Assistant Examiner*—Denise J Buckley
(74) *Attorney, Agent, or Firm*—Hovey Williams LLP

(57) ABSTRACT

The product includes an upright launch tube adapted to be self-supporting on a horizontal surface and a self-propelled aerial pyrotechnic device adapted to be received within a fairly closely confined relationship within the tube in preparation for launch. In its preferred form, the tube is slightly taller than the aerial device so that the aerial device is fully received within and surrounded by the side wall of the tube in the launch mode, except for a long fuse leading to the engine of the device and hanging out over the open upper edge of the tube. Except for a tapered nose cone, the device is substantially the same cross-sectional width along its entire length, including the lower regions thereof which are occupied by a plurality of stabilizing legs that support the device in an upright condition within the tube and balance the device during flight. The annular space surrounding the device within the tube is only slightly greater than that necessary to permit the fuse to extend up alongside of the device and out the open upper end of the tube, thus stabilizing the device prior to launch and during its progressive emergence from the launch tube.

10 Claims, 1 Drawing Sheet

AERIAL FIREWORKS PRODUCT

TECHNICAL FIELD

This invention relates to fireworks in general and, more particularly, to an aerial fireworks product comprising two main components, i.e., an upright launch tube and a self-propelled aerial device adapted to be inserted into, contained within and launched from the tube.

BACKGROUND

Aerial devices such as skyrockets are well-known, as are mortars. Rockets are typically provided with a long stabilizing stick that balances the rocket during flight to keep it from tumbling end-over-end, such stick also serving to provide a means for standing the rocket up against some kind of a support or brace in preparation for launching. Other common expedients for holding the rocket in a pre-launch position include a tube or other open top receptacle which receives the stick while the body of the rocket rests upon or hangs over the upper edge of the receptacle. With such arrangements, the body of the rocket is exposed to persons in the vicinity when the fuse is lighted and as the engine ignites for liftoff. Thus, for safety reasons, the sizes of the charges used in such engines and in the pyrotechnic display materials in the body are typically regulated and closely scrutinized by governmental authorities.

On the other hand, mortars are typically launched from inside upright launch tubes. Such mortars are propelled up and out their launch tubes by a concussion charge that is detonated beneath the mortar but wholly within the tube. Because the mortar has no self-propelling engine and the concussion occurs wholly within the launch tube, the pyrotechnic display charge for mortars is typically allowed by governmental authorities to be significantly larger than that for rockets. Yet, mortars lack the visual aesthetics associated with the exhaust trail of a skyrocket as it arches upward in the night sky.

SUMMARY OF THE INVENTION

Accordingly, an important object of the present invention is to provide an aerial pyrotechnic device that combines the advantages of a skyrocket and a mortar without their attendant disadvantages.

More particularly, an important object of the present invention is to provide a launch tube and a self-propelled aerial device that are so designed and dimensionally related to one another that the self-propelled aerial device is received within and housed by the launch tube in preparation for and during liftoff, although the fuse for the propelling engine of the device extends up and out the open top of the launch tube to be conveniently accessible to the person lighting the fuse. The launch tube is tall enough that, when the aerial device is received within the tube in readiness for launching, the sidewall of the tube surrounds at least a portion of the main body of the device, and preferably the entire length of the main body so that no portion of the device protrudes from the open upper end of the launch tube. In its preferred form, the internal diameter of the launch tube is only slightly greater than the external diameter of the body of the device, providing enough room for the long fuse to be trained from its point of securement to the engine of the device up alongside of the body and between the launch tube sidewall and the body, and thence out the open upper end of the launch tube. Flight stabilizing legs project from the lower end of the body and serve as legs for supporting the device in an upstanding, upright position within the launch tube. Except for a tapered nose cone, the device is substantially the same overall diameter from one end to the other.

DETAILED DESCRIPTION

Figure 1:
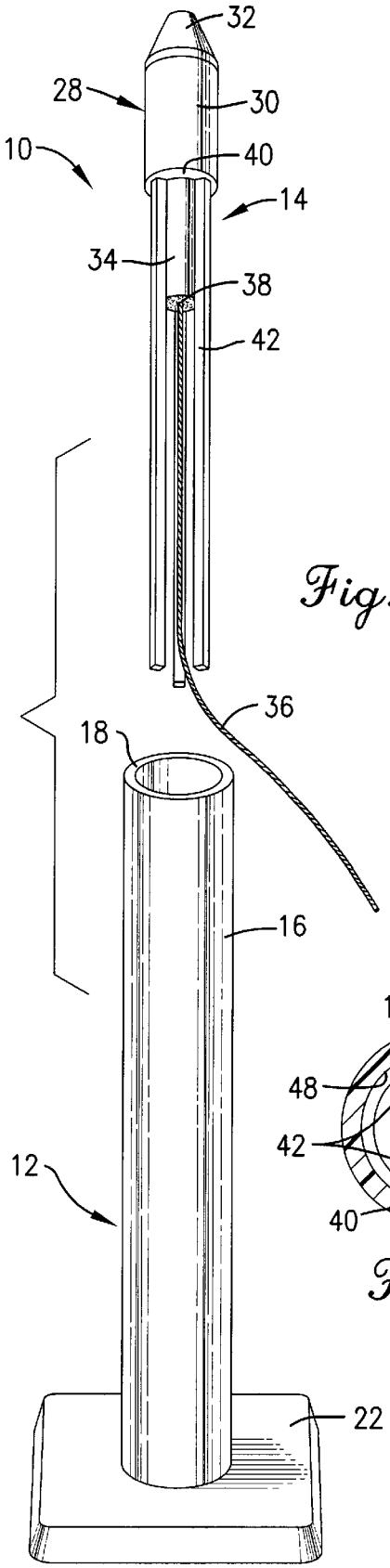
FIG. 1 is an exploded isometric view of a preferred embodiment of the invention illustrating a self-propelled aerial device and a launch tube therefore constructed in accordance with the principles of the present invention.

The aerial pyrotechnic product broadly denoted by the numeral 10 includes two primary components, i.e., a launcher 12 and an aerial device 14 adapted for use with the launcher 12. Launcher 12 includes an upright tube 16 having an open upper end 18 and a closed lower end 20. A base 22 is secured to the lower end 20 of the tube 16 and is adapted to rest on a supporting flat surface in such a manner that the tube 16 is disposed in an upright, essentially vertical disposition. The base 22 has a socket 24 securely receiving the lower end 20 of the tube 16, such socket 24 including a transversely extending web 26 of material that closes off the lower end of the tube 16 and effectively defines a floor of the tube. In the disclosed embodiment, the tube 16 is constructed of a plastic material, but as is well understood by those skilled in this art, the tube may be constructed from other acceptable materials, such as, for example, pasteboard.

In the particular embodiment illustrated in the drawing, the aerial device 14 includes a body 28 that comprises a central packet or canister 30 containing a charge that produces a pyrotechnic display when ignited, a nose cone 32 on the upper end of the canister 30, and an engine 34 attached to the lower end of the canister 30. In another embodiment of the invention (not shown), the body 28 may comprise a pair of stacked balls of pyrotechnic display materials with no nose cone. Other constructions for the body 28 are also possible. The engine 34 contains a charge of propellant that, when ignited, provides lift for the device 14 so as to render it self-propelled in nature. A long fuse 36, having a length that exceeds the total length of the device, is secured at point 38 to the bottom end of the engine 34.

The engine 34 is somewhat smaller in diameter than the canister 30 and coaxial therewith such that a annular ledge 40 or step is presented on the underside of the canister 30 at the interface between the latter and the engine 34. A plurality of straight legs 42 project downwardly from the ledge 40 at spaced intervals around the engine 34 and extend for a substantial distance downwardly beyond the lower end of the engine 34. In the preferred embodiment, there are three of the legs 42, although the number may vary depending upon the amount of stabilizing mass that is required to counter act the tendency for the body 30 of the device to simply cartwheel end-over-end when the engine 34 is ignited rather than fly smoothly in a predicted trajectory. In the preferred form of the invention, the legs 42 comprise sticks of wood, each of which has a generally rectangular cross-sectional configuration.

The legs 42 are all the same length. Thus, when the aerial device 14 is inserted into the launch chamber 44 of the tube 16 with the nose cone 32 pointed upwardly, the legs 42 will come to rest upon the web floor 26 so as to support the device 14 in an upright, vertical orientation. Preferably, the internal diameter of the launch tube 16 is only slightly greater than the maximum cross-sectional width of the aerial device 14 such that a relatively small annular space 46 is defined between the device 14 and the sidewall 48 of the tube 16 when the device 14 is in its launch position within the tube 16. Preferably, the internal diameter of the tube 16 exceeds the maximum transverse cross-sectional width of the device 14 by an amount that is approximately double the thickness of the fuse 36. This provides clearance for the fuse 36 when the device 14 is within the tube 16. It also relatively closely confines the aerial device 14 within the launch chamber 44.

In the preferred embodiment, the tube 16 is somewhat taller than the overall length of the aerial device 14 such that the device 14 is totally received within the tube 16 prior to launch and during ignition of the fuse 36. Alternatively, however, tube 16 may be slightly shorter than the device 14 but, in any event, should at least be of such a height that the sidewall 48 extends upwardly to a point that it at least partially surrounds the canister 30 containing the display charge. In any event, the fuse 36 has such a length that when the device 14 is in place within the launch chamber 44, the fuse extends from its point of securement 38 to the engine 34 up through the annular space 46 and out the open upper end 18 of the tube 16 for access by the person lighting the fuse. Ideally, the fuse 36 will hang over the upper end 18 of the launch tube 16 and down the outside of the tube 16 for a substantial distance.

Figure 3:
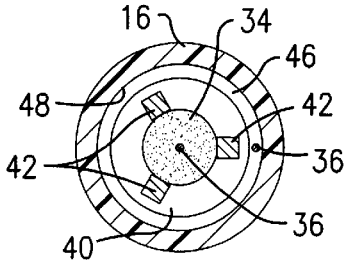
FIG. 3 is a transverse cross-sectional view through the aerial device taken substantially along line 3—3 of FIG. 2.
Figure 2:
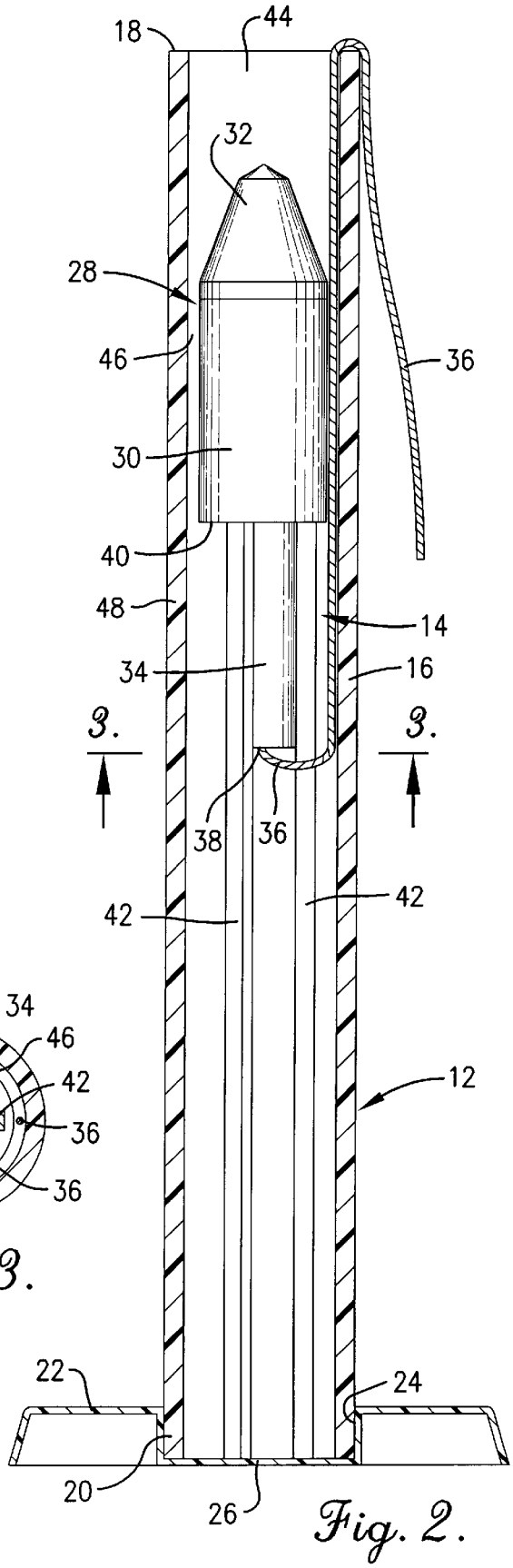
FIG. 2 is a slightly enlarged vertical cross-sectional view of the launch tube and aerial device when the device is fully received within the tube preparatory to launching.

It will be appreciated that the aerial device 14 is of substantially the same diameter over its full length, with the exception of the tapering nose cone 32. As illustrated in FIG. 3, having the legs 42 project from the ledge 40 on the underside of the canister 30 permits the legs 42 to be set in or recessed with respect to the profile presented by the external wall of the canister 30. Consequently, the presence of the stabilizing legs 42 does not increase the overall transverse cross-sectional width of the device. Therefore, when the device is within the tube 16, it is maintained in a relatively closely confined environment so as to maintain the device substantially vertical prior to launch and to maintain such vertical orientation as the device lifts off and progressively emerges from the upper end of the tube. This helps assure that the trajectory of the device will be substantially vertical, rather than on an incline as is typically true in rocket-style aerial devices.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of their invention as pertains to any apparatus not materially departing from but outside the literal scope of the invention as set out in the following claims.

What is claimed is:

1. An aerial fireworks product comprising:

a launcher including a tube adapted to be disposed in an upright condition, said tube having upper and lower ends and a continuous, annular sidewall extending between said ends to define an elongated, internal launching chamber within the tube, said upper end of the tube being open; and a self-propelled aerial pyrotechnic device having no fins and adapted for launching from said launcher, said device including, a body at an upper end of the device including a collection of ignitable incendiary display materials and an engine containing a charge for propelling the device when the charge is ignited, said engine being attached to and traveling with the collection of ignitable incendiary materials when the device is being propelled by the engine, stabilizing structure secured to the body and projecting therefrom at a lower end of the device for supporting the body above the lower end of the tube when the device is placed in the launch chamber with the upper end of the device up and the lower end of the device down, and for stabilizing the device during flight after launching from the tube, said stabilizing structure including a plurality of fixed legs projecting downwardly from the body beyond the lower end of the engine, said legs being fixed against outward movement both before and during flight so that the transverse cross-sectional width of the device remains constant at all times, and a fuse secured to and leading from said engine, said tube having an internal diameter that exceeds the maximum transverse cross-sectional width of the device and a height that causes at least the legs, the engine, and the collection of ignitable, incendiary materials of the device to be surrounded by the wall of the tube when the device is contained within the launch chamber and topresent a generally annular space between the body and the sidewall, said fuse having a length that exceeds the distance between its point of securement to the engine and the open upper end of the tube when the device is contained within the launch chamber whereby to cause the fuse to extend through said annular space and out the open upper end of the tube when the device is loaded into and contained within the tube in preparation for launching.

2. An aerial fireworks product as claimed in claim 1, said lower end of the launch tube being closed to present a floor, said legs of the aerial device being disposed to stand on said floor when the device is contained within the launch chamber of the tube.

3. An aerial fireworks product as claimed in claim 1, said height of the tube being such that the entire body of the aerial device is surrounded by the sidewall of the tube when the device is received within the launch chamber.

4. An aerial fireworks product as claimed in claim 1, said fuse having a thickness, said internal diameter of the launch tube exceeding the maximum transverse cross-sectional width of the device by an amount that is approximately double the thickness of the fuse.

5. An aerial fireworks product as claimed in claim 1, said legs of the aerial device being so disposed that the transverse cross-sectional width of the device through the legs does not exceed the transverse cross-section width of the device through the body.

6. An aerial fireworks product as claimed in claim 5, said transverse cross-sectional width of the device through the legs being approximately the same as the transverse cross-sectional width of the device through the body.

7. An aerial fireworks product as claimed in claim 3, said fuse having a thickness, said internal diameter of the launch tube exceeding the maximum transverse cross-sectional width of the device by an amount that is approximately double the thickness of the fuse.

8. An aerial fireworks product as claimed in claim 7, said legs of the aerial device being so disposed that the transverse cross-sectional width of the device through the legs does not exceed the transverse cross-section width of the device through the body.

9. An aerial fireworks product as claimed in claim 8, said transverse cross-sectional width of the device through the legs being approximately the same as the transverse cross-sectional width of the device through the body.

10. An aerial fireworks product as claimed in claim 1, said launch tube having a height that exceeds the overall length of the aerial device.

* * * * *